United States Patent [19]

Ohshima et al.

[11] 4,015,166

[45] Mar. 29, 1977

[54] X-Y MATRIX TYPE ELECTROLUMINESCENT DISPLAY PANEL

[75] Inventors: Nobumasa Ohshima; Hiroshi Kawarada, both of Hirakata; Shinichi Noma, Katono; Toshio Tatsumichi, Ando, all of Japan

[73] Assignee: Matsushita Electric Industrial Co., Ltd., Kadoma, Japan

[22] Filed: May 4, 1976

[21] Appl. No.: 683,215

Related U.S. Application Data

[63] Continuation-in-part of Ser. No. 394,860, Sept. 6, 1973, abandoned.

[30] Foreign Application Priority Data

Sept. 6, 1972 Japan ..... 47-89747
Oct. 20, 1972 Japan ..... 47-105432

[52] U.S. Cl. ..... 313/503; 313/505; 313/509

[51] Int. Cl.[2] ..... H05B 33/02; H05B 33/14; H05B 33/22

[58] Field of Search ..... 313/505, 509, 503

[56] References Cited

UNITED STATES PATENTS

| | | | |
|---|---|---|---|
| 2,698,915 | 1/1955 | Piper | 315/362 |
| 3,015,036 | 12/1961 | Butler | 250/213 |
| 3,059,118 | 10/1962 | Koury | 313/509 X |
| 3,107,315 | 10/1963 | Wolfe et al. | 315/169 |
| 3,368,099 | 2/1968 | Arnold | 313/509 |
| 3,502,885 | 3/1970 | Stewart | 313/505 |
| 3,504,214 | 3/1970 | Lake et al. | 313/507 |
| 3,573,530 | 4/1971 | Kohashi | 313/505 |
| 3,650,824 | 3/1972 | Szepesi et al. | 313/498 X |

*Primary Examiner*—Palmer C. Demeo
*Attorney, Agent, or Firm*—Wenderoth, Lind & Ponack

[57] ABSTRACT

This invention relates to an X-Y matrix type electroluminescent display panel. The panel includes a transparent insulating substrate, transparent and parallel X-electrodes of strip shape provided on said transparent insulating substrate, a D.C. electroluminescent layer provided on said transparent parallel electrodes; parallel Y-electrodes of strip shape provided on said D.C. electroluminescent layer, the direction of said Y-electrodes being perpendicular to that of said X-electrodes, said X- and Y-electrodes and said D.C. electroluminescent layer defining display elements at the intersections of said X- and Y-electrodes; and a mesh-shaped insulating layer, preferably of black color, for insulating said display elements from each other at least in the vicinity of said X-electrodes. Because of the mesh-shaped insulating layer, it becomes possible to achieve uniform "forming" of said D.C. electroluminescent layer and to improve the brightness and contrast of the resultant display panel.

6 Claims, 3 Drawing Figures

X-Y MATRIX TYPE ELECTROLUMINESCENT DISPLAY PANEL

This application is a continuation-in-part of application Ser. No. 394,860, filed Sept. 6, 1973, and now abandoned.

This invention relates to an X-Y matrix type electroluminescent display panel.

A conventional X-Y matrix type electroluminescent display panel comprises a transparent insulating substrate, transparent and parallel X-electrodes of strip shape provided on said transparent insulating substrate, a D.C. electroluminescent layer having a uniform thickness and provided on said parallel X-electrodes of strip shape and parallel Y-electrodes of strip shape provided on said D.C. electroluminescent layer, the direction of said Y-electrodes being perpendicular to that of said X-electrodes, said X- and Y-electrodes and said D.C. electroluminescent layer defining display elements at the intersections of said X- and Y-electrodes. The D.C. electroluminescent layer usually comprises D.C. electroluminescent powder dispersed in a resin binder. The transparent parallel X-electrodes are usually made by first providing a transparent conductive coating and etching away unnecessary parts of the transparent conductive coating. The Y-electrodes are usually made by metal evaporation. There are many kinds of electroluminescent materials having high resistivities and low resistivities. It is preferable that the electroluminescent material in a display panel have low resistivity in order to obtain a brighter display. For example, ZnS powder using Mn as an activator and having a Cu or Cu sulfide conductive coating on the surface of each particle thereof is known to be a D.C. electroluminescent material, its resistivity being varied by means of a Cu coating treatment. The lower the resistivity of the D.C. electroluminescent material is, the higher the brightness of the resultant display panel is. However, conventionally it has not been possible to use a D.C. electroluminescent material having a very low resistivity because of the necessity of carrying out a so called "forming" treatment. When a D.C. voltage is applied between the X-electrodes and the Y-electrodes, a large current initially flows through the D.C. electroluminescent layer, and then the current starts decreasing and the electroluminescent layer starts emitting light. As the current decreases the intensity of the light emission from the electroluminescent layer increases. Thus, the D.C. electroluminescent layer, as a whole, becomes higher in the resistivity than before the forming treatment. Particularly, the D.C. electroluminescent layer in the vicinity of the anode becomes very high in the resistivity, and the light emission is mainly attributed to this very high resistive region. This phenomenon is called forming, and the treatment therefor is called a forming treatment. Since the forming treatment thus causes a D.C. electroluminescent display panel to increase its brightness and efficiency of light emission, the forming treatment is always necessary for obtaining a display panel of better light emitting characteristics. The forming phenomenon is first observed at the display element nearest the source of the D.C. voltage, and then travels to display elements more remote from the source of the D.C. voltage. The speed with which the forming phenomenon goes from the display element nearest the voltage source to display elements more remote from the voltage source is called the "forming speed". In the conventional display panel, two adjacent display elements are connected by a portion of the electroluminescent layer, which portion is therefore a current path, so that the forming speed is low. Since the forming treatment also causes the heating of the electroluminescent layer, when the electroluminescent material used has very low resistivity and the forming speed is low, the electroluminescent layer is likely to be ignited by the forming treatment by the time the entire display panel is uniformly treated by the forming treatment. Therefore, a uniform forming treatment has been very difficult to obtain according to the conventional technique.

Furthermore, when the display panel is of such a structure that the thickness of the electroluminescent layer is between 20 and 30 microns and the distance between two adjacent X-electrodes is approximately a few hundred microns, the resistance of the electroluminescent layer between the two adjacent X-electrodes is higher before the forming treatment but lower after the forming treatment than the resistance of the electroluminescent layer measured in the direction of the thickness thereof. Therefore, even if uniform forming could be achieved, the conventional display panel would have a disadvantage in that current leakage occurs between two adjacent X-electrodes, which causes unnecessary light emission at places between adjacent display elements, resulting in a reduction of the resultant contrast of a displayed image.

Therefore, it is a primary object of this invention to provide an X-Y matrix type electroluminescent display panel which can be easily treated by a uniform forming treatment, even in the case of an electroluminescent layer of very low resistivity and which display panel has high brightness and contrast.

These objects are achieved according to the invention by the provision of an X-Y matrix type electroluminescent display panel comprising a transparent insulating substrate, flat transparent and parallel strip shaped X-electrodes on said transparent insulating substrate, a D.C. electroluminescent layer on said flat transparent parallel electrodes, parallel strip shaped Y-electrodes on the D.C. electroluminescent layer, the direction of said Y-electrodes being perpendicular to that of said X-electrodes, said X- and Y-electrodes and said D.C. electroluminescent layer defining display elements at the crossing points of said X and Y-electrodes, and a mesh shaped insulating layer within said D.C. electroluminescent layer and mounted on said X-electrodes for insulating said display elements from each other at least in the vicinity of said X-electrodes, said insulating layer being a photo-resist material.

The thickness of said mesh-shaped insulating layer and said electroluminescent layer are preferably in the relation $0.03 \leqq d_1/d_2 \leqq 1$, when $d_1$ and $d_2$ represent the thickness of said mesh shaped insulating layer and said electroluminescent layer, respectively. The mesh shaped insulating layer preferably insulates said display elements from each other substantially completely.

The color of said mesh-shaped insulating layer can be a light absorbing color. The photo-resist material can be black.

The D.C. electroluminescent layer can be made by mixing a D.C. electroluminescent material with a resin binder, coating the mixture on said X-electrodes and hardening the coating, the amount of said mixture coated on the X-electrodes being such that when the coating is hardened it has a thickness of 15 to 80 microns.

The D.C. electroluminescent material can be an Mn activated ZnS powder having a Cu or copper sulfide conductive layer on each particle thereof.

It is a further finding according to this invention that when the mesh-shaped insulating layer is of a light absorbing color such as black, the mesh-shaped insulating layer decreases the the reflection of light from outside at the surface of the display panel and also suppresses optical blur at edges of display elements so as to make the displayed image clearer and more sharp.

These and other features of this invention will be apparent from the following detailed description taken together with the accompanying drawings, wherein.

Figure 1:
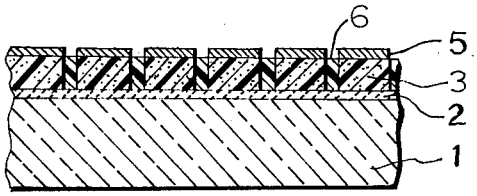
FIG. 1 is a cross-sectional view of one example of the X-Y matrix type electroluminescent display panel according to this invention, cut by a plane extending in a direction perpendicular to the direction in which each Y-electrode extends.
Figure 2:
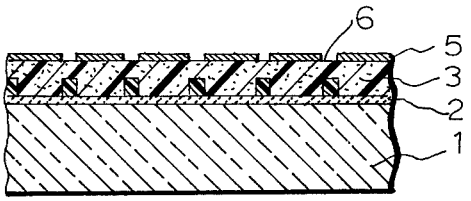
FIG. 2 is a cross-sectional view of another example of the X-Y matrix type electroluminescent display panel according to this invention, cut by a plane extending in the direction perpendicular to the direction in which each Y-electrode extends.
Figure 3:
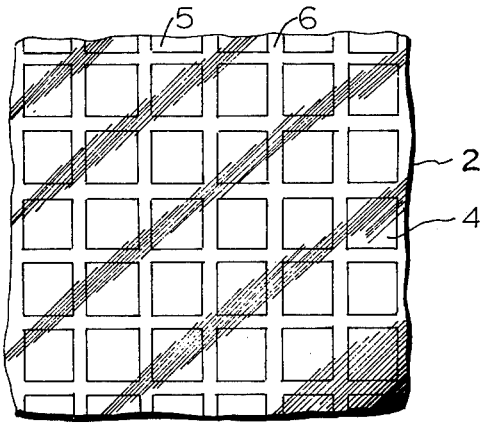

FIG. 2*a* is a partial cross-sectional view, on an enlarged scale, of the display panel of FIG. 2 having been subjected to the forming treatment, cut by a plane extending in a direction perpendicular to the direction in which each X-electrode extends, for explaining the state of the panel having been subjected to the forming treatment;

FIG. 3 is a bottom plan view of the X-Y matrix type electroluminescent display panel as in FIG. 1 or 2 observed through the transparent insulating substrate; and FIGS. 4*a* and 4*b* are diagrams of the exciting voltage wave and the brightness response of the panel of the present invention thereto.

In the Figures, same reference numerals designate the same elements.

Referring to FIGS. 1, 2 and 3, reference numerals 1, 2, 3, 4, 5 and 6 designate (1) a transparent insulating substrate, (2) transparent parallel electrodes (X-electrodes) having a strip shape, (3) a D.C. electroluminescent layer, (4) display elements, (5) parallel Y-electrodes having a strip shape, and (6) a mesh-shaped insulating layer for insulating the display elements from each other, respectively.

In preparing the display panel of this invention a transparent insulating material such as glass or plastic sheet is used for the transparent insulating substrate 1. On the transparent insulating substrate 1 a transparent conductive coating such as of tin oxide, indium oxide or copper iodide is provided. By a well known etching technique, unnecessary portions of the transparent conductive coating are removed so as to leave portions corresponding to parallel X-electrodes 2. On the thus made X-electrodes 2, a low resistance D.C. electroluminescent layer 3 is provided. The layer 3 has a mesh-shaped insulating layer 6 attached thereto for insulating the portions of the electroluminescent layer from each other, the portions corresponding to the resultant display elements. On the electroluminescent layer further strip shaped parallel electrodes (Y-electrodes) 5, which extend in a direction perpendicular to that of the X-electrodes, are provided by any available and suitable method such as metal evaporation. Thus, an X-Y matrix type electroluminescent display panel is made.

Next, the display panel having the D.C. electroluminescent layer of uniform resistivity is subjected to the forming treatment for obtaining better light emitting characteristics. By this forming treatment, a light emitting region 3*a* which has particularly high resistivity is formed in the D.C. electroluminescent layer 3 in the vicinity of the X-electrodes (anodes) as shown in FIG. 2*a*. The other portion of the D.C. electroluminescent layer than the particularly high resistive layer 3*a* is a relatively low resistive layer after the forming treatment. The relatively low resistive layer after the forming treatment has high resistivity than the low resistivity of the uniform D.C. electroluminescent layer before the forming treatment.

One of the features of the display panel according to this invention is that unnecessary current paths in the electroluminescent layer are cut off by providing a mesh-shaped insulating layer 6 the resistance of which is sufficiently larger than that of the electroluminescent layer 3. Because of this, electric currents flowing during the forming treatment flow mainly through display elements, so that the time required for the forming treatment when the insulating layer 6 is present is reduced to about one tenth of the time required for panels without the insulating layer 6, when the resistivity of the electroluminescent layer is low. Furthermore, according to the arrangement of this invention, the amount of current necessary for the forming treatment can be small and the time used for the forming treatment can be short because the current can be effectively used (small leakage current, etc.), so that if a D.C. electroluminescent layer of low resistivity is used, such low resistive D.C. electroluminescent layer can be prevented from being burnt out due to the heat produced at the forming treatment, and so it becomes possible to use a low resistive D.C. electroluminescent layer, which contributes to good light emitting characteristics. Therefore, the brightness of the display panel can be increased by several times according to this invention in comparison with the conventional display panel.

A display panel treated by the forming treatment emits light from the regions thereof in the vicinity of X-electrodes (anodes), and the light emitting regions are high resistance areas as a result of the forming treatment. But the resistance between two adjacent X-electrodes (anodes) is not so high however. Therefore, in a conventional display panel, current leakage occurs between two adjacent X-electrodes, resulting in the production of unwanted light emission and hence in a decrease of contrast. However, according to this invention, such current leakage between two adjacent electrodes can be prevented so as to prevent a decrease of contrast. This is most effective in the case when a lower resistive electroluminescent material is used in order to obtain higher brightness.

Another feature of the display panel according to this invention is that by coloring the insulating layer 6 black, gray or any other light absorbing color, the reflection of light from outside at the surface of the display panel can be descreased, and the blur in the emitting light at the edges of display elements can be optically suppressed.

The insulating layer 6 can be made by any suitable and available method. A convenient method is to first coat a photosensitivitive resin layer (photo-resist), and then remove unnecessary parts from the coated photosensitive resin layer by a well known photo-etching technique so as to leave a photosensitive resin layer having a desired pattern which corresponds to the insulating layer 6. when the thickness of the insulating layer 6 is represented by $d_1$ and the thickness of the electroluminsescent layer 3 is $d_2$, it is not necessary that $d_1=d_2$, although the condition $d_1=d_2$(i.e. the insulating layer 6 substantially completely insulates the display elements from each other) gives the best results. According to this invention, the preferred condition is $0.03 \leqq d_{12} \leqq 1$. FIG. 1 shows an arrangement when $d_1=d_2$, which is most preferable. However, since the electroluminescent layer 3 emits light from the regions thereof in the vicinity of the X-electrodes (anodes), an effect of the insulating layer 6, which is sufficient from a practical standpoint, can be obtained is $0.03 \leqq d_1/d_2$, as shown in FIG. 2.

Therefore, the provision of the insulating layer 6 within the D.C. electroluminescent layer as in the present invention (particularly in the vicinity of the X-electrode) is very effective, since the insulating layer prevents the leakage current which might flow through the D.C. electroluminescent layer between adjacent X-electrodes. In the case of $d_1/d_2<1$, the current leakage (between adjacent display elements) the leakage path of which is only in the vicinity of the X-electrodes is prevented by the insulating layer, and the current leakage the leakage path of which extends also to the relatively low resistive D.C. electroluminescent layer is practically negligible because the high resistive D.C. electroluminescent layer after the forming treatment suppresses such a current leakage. Thereby, the contrast of the image formed by the display elements is improved. The reason why the insulating layer is provided in the D.C. electroluminescent layer in the vicinity of the X-electrode in the embodiment of FIG. 2 is because the light emission occurs in the electroluminescent layer in the vicinity of the X-electrode, and the trouble to be solved is leakage current in the light emission region of the electroluminescent layer. It is apparent that the X-electrode side, in the vicinity of which the insulating layer is provided, is the side from which a viewer views the electroluminescent panel. On the other hand, between adjacent Y-electrodes also, current leakage which might be seriously large from a practical point of view does not occur. The reason for this can be presumed as follows. At the forming treatment, heat is generated by the forming current, and thereby the resistivity of the D.C. electroluminescent layer between adjacent Y-electrodes becomes higher than that before the forming treatment. Further, in the case when the thickness of the insulating layer inserted in the D.C. electroluminescent layer between the X-electrodes is large, the current path between adjacent Y-electrodes becomes narrow. Due to these, current leakage between Y-electrodes can practically be prevented.

The initial D.C. electroluminescent layer, i.e. before the forming treatment, can be made by any suitable and available method. Usually it is made by mixing a D.C. electroluminescent material powder with a resin binder, coating the mixture on the substrate, and hardening the coating. The thickness of the hardened coating, i.e. the electroluminescent layer, is preferably from 15 to 80 microns.

Any available and suitable material can be used for the electroluminescent material powder. It is preferred that the D.C. electroluminescent material powder be made by coating the surface of each particle of ZnS powder activated with Mn with Cu or copper sulfide conductive layer. It is preferred for obtaining a bright display that the D.C. electroluminescent material have a low resistivity. But, as set forth above, suitable D.C. electroluminescent materials for use in a conventional display panel are limited. For checking resistivity, an electroluminescent material powder is placed in a hollow cylindrical cell and pressed in the direction of the axis of the cylinder with a pressure of 65 kg/cm$^2$. Then a D.C. voltage is applied between top and bottom electrodes. The resistivity of the D.C. electroluminescent material powder can thus be determined. When a D.C. electroluminescent material having a resistivity of less than about 20 Ω. cm is used in a conventional display panel, the D.C. electroluminescent layer starts burning during the forming treatment, and even if the forming treatment can be carried out, the resultant image contrast is very poor due to current leakage between adjacent X-electrodes. Therefore, such low resistive material cannot normally be used. However, according to this invention, an electroluminescent material having a resistivity as low as above 5.Ωcm can be used.

Any suitable and available material can be used for the resin binder. For example, acryl resin, urea resin or epoxy resin can be used therefor. It is preferred that the ratio of the electroluminescent material to the resin binder be from 6:1 to 1:1 by weight. The preferred temperature for hardening the coating of the mixture of the resin binder and the electroluminescent material is about 120° to 160° C.

This invention will be understood more readily with reference to the following Examples 1 and 2, but these Examples are intended to only illustrate the invention and not to be construed to limit the scope of the invention.

EXAMPLE 1

By etching transparent tin oxide film having an area of 100 × 100mm$^2$ and coated on a glass substrate 1, 80 flat and parallel transparent strip-shaped electrodes 2, each having a width of 1.0mm were made on the glass substrate, all the parallel strips being equidistantly spaced from each other at a gap distance of 0.2mm. On the transparent electrodes 2 on the glass substrate 1, a mesh-shaped insulating layer 6 was provided at positions which, when viewed from the bottom through the glass substrate, correspond to all the gaps between the parallel electrodes and to all the gaps (gap distance: 0.15mm) of further parallel electrodes which would be later provided in a direction perpendicular to that of the first made parallel electrodes. The mesh-shaped insulating layer was made by first providing a photoresist layer 10 microns thick and removing unnecessary parts by a well known photo-etching technique. KPR (trade name of photo-resist of Kodak Co., U.S.A.) was used for the photo-resist layer. Then, a diluted photoresist Dye Black (trade name of photo-resist black dye of Kodak Co., U.S.A.) was applied to the thus formed insulating layer 6 so as to color the insulating layer 6 to an optical density of 0.45.

One weight part of urea resin was mixed with two weight parts of Mn-activated ZnS powder having Cu coating on each particle thereof. The mixture was diluted by diacetone alcohol. The diluted mixture was applied to the glass substrate 1 with the parallel electrodes 2 and the insulating layer 6 thereon by using a silk screen method. The diluted mixture thus applied was heated at 160° C for one hour so as to be hardened.

The thus hardened mixture was a D.C. electroluminescent layer 3 and has a thickness of about 36 microns.

Thereafter, aluminum was vacuum-evaporated on the surface of the electroluminescent layer 3 in a pattern on ninety parallel strips each having a width of 0.75 mm, in which the direction of the parallel strips is perpendicular to that of the previously made electrodes and all the strips are equidistantly spaced with a gap therebetween of 0.15 mm corresponding to the mesh-shaped insulating layer 6. The thus made aluminum films are parallel electrodes 5.

Next, in order to make the display panel have better light emitting characteristics, the D.C. electroluminescent layer was subjected to a forming treatment by using a D.C. voltage source variable from 20 V to 150 V with each parallel transparent electrode 2 being as an anode and each parallel aluminum electrode 5 being as a cathode, whereby a light emitting region of particularly high resistivity was formed in the D.C. electroluminescent layer in the vicinity of the parallel transparent electrodes 2, as shown in FIG. 2*a*. Thus, the display panel was produced.

For comparison, a conventional display panel was made in a manner substantially the same as making the display panel as set forth above, except that in making the conventional display panel, the insulating layer was omitted.

The resistance between two adjacent parallel electrodes of tin oxide was measured with respect to both the display panel of this invention and the conventional display panel. It was found by this measurement that the resistance thus measured with respect to the display panel of this invention was about 10 times higher than that of the conventional panel, so that current leakage between two adjacent parallel electrodes of tin oxide in the panel of the present invention is prevented for all practical purposes.

EXAMPLE 2

An electroluminescent display panel was made in a manner substantially the same as the manner described in Example 1, except that a blue colored photo-resist sheet Riston (trade name of photo-resist sheet of Du-Pont Co., U.S.A.) 36 microns thick was used, instead of KPR, which was used in Example 1, for obtaining the insulating layer 6. Therefore, in the display panels made in this Example the insulating layer 6 insulated display elements from each other substantially completely. FIG. 1 shows a cross-sectional view of the thus made display panel. This display panel was superior to the display panel (with the insulating layer 6) made in Example 1, because display elements were completley insulated from each other by the insulating layer.

Many display panels were made in the manner described above in Example 2, but in which the resistivities of the electroluminescent materials were changed. (The resistivities were measured by using a hollow cylindrical cell as described above). The ability to carry out a uniform forming treatment, and the brightness and contrast of the thus made display panels and the conventional display panels made according to Example 1 were checked. In checking brightness, a pulse voltage with a amplitude of 250 V, pulse width of 120 μsec and repeating frequency of 60 Hz. The following table shows the results of these checks

| | | Resistivities of electroluminescent material | | | |
|---|---|---|---|---|---|
| | Properties | less than 5 Ω.cm | 5–20 Ω.cm | 20–30 Ω.cm | more than 30 Ω.cm |
| Conventional display panel | Uniform forming treatment | Not possible | Not possible | Difficult | Possible |
| | Brightness | | | 30–10 ft-L | less than 10 ft-L |
| | Contrast | | | about 5:1 | more than 10:1 |
| This invention's display panel | Uniform forming treatment | Difficult | Possible | Possible | Possible |
| | Brightness | | 50–30 ft-L | 30–10 ft-L | less than 10 ft-L |
| | Contrast | | about 20:1 | about 20:1 | more than 20:1 |

In the display panel of the present invention being made of formed D.C. electroluminescent layer, i.e. the electroluminescent layer which has been subjected to a forming treatment, when a pulsed D.C. voltage as shown in FIG. 4*a* is applied thereto to produce electroluminescent light emission, although there are some delays in the response to the pulsed D.C. voltage at the leading edge and the trailing edge of the pulse, as seen in FIG. 4*b*, the electroluminescent light emission depends on the amplitude V and the width of the D.C. component of the pulse.

The technique of this invention makes it possible to use a very low resistance D.C. electroluminescent material, i.e. material with a resistance as low as 5–30Ω.cm, which cannot be used according to conventional techniques. Consequently, according to this invention, the brightness can be made to be several times higher than for panels made according to conventional techniques. Further, it was found that in a panel according to this invention, current leakage between adjacent transparent and parallel electrodes (X-electrodes) can be suppressed by the insulating layer 6, resulting in an increase of image contrast. Furthermore, when the insulating layer was of a light absorbing color, such as black or blue, the reflection of light from outside at the surface of display panel is decreased, resulting in an increase of image clearness. Moreover, it was observed that the light absorbing color of the insulating layer 6 contributed to suppression of unwanted optical blur at the edges of the display elements.

It should be noted that it is necessary to increase the number of electrodes in the limited space of a display panel in order to increase the resolving power of the display panel for obtaining clearer images. To do so, it is necessary to shorten the distance between adjacent electrodes. However, if the distance between adjacent electrodes is shortened, the current leakage becomes a more serious factor in the conventional panels. Panels according to this invention, therefore, have a larger advantage when the distance between adjacent electrodes is shortened.

What we claim is:

1. An X-Y matrix type electroluminescent display panel comprising:

a transparent insulating substrate; flat transparent and parallel strip-shaped X-electrodes on said transparent insulating substrate; a formed D.C. electroluminescent layer on said flat transparent parallel electrodes; parallel strip-shaped Y-electrodes on said D.C. electroluminescent layer, the direction of said Y-electrodes being perpendicular to that of said X-electrodes, said X- and Y-electrodes and said D.C. electroluminescent layer defining display elements at the crossing points of said X- and Y-electrodes; and a mesh-shaped insulating layer within said D.C. electroluminescent layer and mounted on said X-electrodes and extending at least part way through the thickness of said D.C. electroluminescent layer for insulating said display elements from each other at least in the vicinity of said X-electrodes, said insulating layer being a photo-resist material.

2. An X-Y matrix type electroluminescent display panel according to claim 1 wherein the thickness of said mesh-shaped insulating layer and said electroluminescent layer are in the relation:

$$0.03 \leqq d_1/d_2 \leqq 1$$

where $d_1$ and $d_2$ represent the thicknesses of said mesh-shaped insulating layer and said electroluminescent layer, respectively.

3. An X-Y matrix type electroluminescent display panel according to claim 1 wherein said mesh-shaped insulating layer insulates said display elements from each other substantially completely.

4. An X-Y matrix type electroluminescent display panel according to claim 1 wherein the color of said mesh-shaped insulating layer is a light absorbing color.

5. An X-Y matrix type electroluminescent display panel according to claim 4 wherein said photo-resist material is black.

6. An X-Y matrix type electroluminescent display panel according to claim 1, wherein said D.C. electroluminescent material comprises an Mn activated ZnS powder having a Cu or copper sulfide conductive layer on each particle thereof.

* * * * *